US005467808A

United States Patent [19]

Bell

[11] Patent Number: 5,467,808

[45] Date of Patent: Nov. 21, 1995

54

[54] BLIND OR CURTAIN SUSPENSION SYSTEM

[75] Inventor: David Bell, Bradford, United Kingdom

[73] Assignee: Eclipse Blinds Limited, Renfrew, Scotland

[21] Appl. No.: 180,087

[22] Filed: Jan. 11, 1994

[51] Int. Cl.[6] ..... E06B 9/30

[52] U.S. Cl. ..... 160/168.1; 160/900; 160/343

[58] Field of Search ..... 160/168.1 P, 176.1 P, 160/1, 5, 7, 331, 343, DIG. 17, 188

[56] References Cited

U.S. PATENT DOCUMENTS

| | | | |
|---|---|---|---|
| 3,003,552 | 10/1961 | Eilenberger | 160/331 |
| 3,774,665 | 11/1973 | Bourne | 160/331 X |
| 4,618,804 | 10/1986 | Iwasaki | 160/DIG. 17 X |
| 4,712,104 | 12/1987 | Kobayashi | 160/DIG. 17 X |
| 4,856,574 | 8/1989 | Minami et al. | 160/168.1 P |
| 4,896,713 | 1/1990 | Rademacher | 160/168.1 P |
| 4,902,953 | 2/1990 | Kraft et al. | 160/DIG. 17 X |
| 4,913,214 | 4/1990 | Ming | 160/168.1 P |
| 4,914,360 | 4/1990 | Hsieh et al. | 160/168.1 P X |
| 4,956,588 | 9/1990 | Ming | 160/331 X |
| 5,270,629 | 12/1993 | Hsieh | 160/DIG. 17 X |
| 5,371,447 | 12/1994 | Boss | 160/1 X |

*Primary Examiner*—David M. Purol
*Attorney, Agent, or Firm*—Edwin D. Schindler

[57] ABSTRACT

An automatic blind or curtain suspension system is described comprising a blind headrail 10 or curtain pole carrying at least one suspension device 28 arranged for movement relative to the headrail 10 or pole towards and away from a stop 48 to open and close the blind or curtain. An electric motor 44*a* is coupled to the suspension device 28 and operable to cause it to move relative to the headrail 10 or pole. The system includes compression springs 50 adapted to take up additional drive from the motor once motion of the suspension device 28 is retarded by the stop 48. An automatic controller 12 is provided which detects a monotonic increase in current to the motor 44*a* associated with drive from the motor 44*a* being taken up by the springs 50 and interrupts current to the electric motor 44*a* when the increase in motor current is detected. The controller may also keep track of the position of the suspension device 28 and store its position when the increase in current is detected. Drive to the electric motor 44*a* during subsequent operation of the system may then be regulated in dependence upon the stored value to interrupt current to the motor before the suspension device 28 hits the stop 48 again.

18 Claims, 5 Drawing Sheets

BLIND OR CURTAIN SUSPENSION SYSTEM

BACKGROUND OF THE INVENTION

1. Technical Field of the Invention

This invention relates to a suspension system for window blinds, shutters or the like, and to control apparatus adapted for use therewith.

Common manually operated blind or curtain suspension systems, which may be either the standard manually operable type or the corded manually operable type, can comprise the security of the dwelling place during periods of absence, and it is therefore desirable to provide a blind/curtain suspension system which lends itself readily to automatic operation. Such a system would not only alleviate the problem of security but would also be of benefit to the disabled, blind, elderly or infirm occupants.

2. Description of the Prior Art

Exiting automatic blind/curtain suspension systems generally include a support carrying at least one suspension device arranged for movement relative to the support towards and away from a stop to open and close the blind/curtain, and an electric motor coupled to the suspension device and operable to cause movement of the suspension device relative to the support. Such suspension systems have hitherto operated in one of two ways. In the first, motion of the suspension device or devices relative to the support is arrested at either end of its travel by means of dead stops, i.e. fixed stops against which the leading suspension device impacts at one or other extreme of its travel. The effect of this is that the motor stalls, which leads almost instantaneously to a very large increase in motor current, known as "overcurrent". Overcurrent detectors may be provided to switch power to the motor off should the current to the motor exceed a predetermined value, but by the time overcurrent is detected, the motor has already stalled and the motor and the remainder of the system suffered the mechanical stresses induced.

Apart from the mechanical stresses mentioned above, a further problem arises with the use of dead stops. When the leading suspension device impacts the stop, the motor will continue to drive for a very short period of time until the torque to which the suspension device is tightened against the stop reaches the stall torque rating of the motor. At this point, the motor stalls. If sufficient friction is present in the system, e.g. where the suspension device is carried by a nut traversing a threaded, driven shaft, releasing the suspension device from abutment with the stop requires the motor to exert a torque greater than and opposite to that which tightened the suspension device against the stop in the first place. Inertia present in the motor and drive mechanism when the motor is brought to a halt will also be taken up in tightening the suspension device against the stop. This, together with the fact that static friction instead of dynamic friction must be overcome, means that there is a good chance that the suspension device will jam against the stop and need to be released by hand.

As an alternative to the use of dead stops, some available blind/curtain suspension systems utilize limit switches which are actuated by the passing suspension device. The use of limit switches contributes significantly to the cost of the system, requiring additional wiring and additional control hardware, for example to allow the motor to be reversed once it has tripped a limit switch, but advanced no further until it has been reversed. This again contributes to the cost, making the use of limit switches a relatively expensive option.

SUMMARY OF THE INVENTION

The present invention seeks to provide a blind/curtain suspension system which overcomes the above disadvantages. The invention also seeks to provide control apparatus adapted for the improved automatic control of a blind/curtain suspension system.

According to a first aspect of the present invention there is provided a blind/curtain suspension system comprising a support carrying at least one suspension device arranged for movement relative to the support towards and away from a stop to open and close the blind/curtain, an electric motor coupled to the suspension device and operable to cause movement of the suspension device relative to the support, a resilient component adapted to take up additional drive from the motor once motion of the suspension device is retarded by the stop and a controller including means for detecting an increase in current to the motor associated with drive from the motor being taken up by the resilient component and means for interrupting current to the electric motor when the increase in motor current is detected.

As will be described below, the system according to the first aspect of the present invention does not require the use of limit switches and their associated hardware and does not suffer from the mechanical stress and/or torsional shock and jamming problems hitherto associated with the use of dead stops.

The suspension system according to the present invention makes use of an adaptive control. The controller includes means for detecting an increase in motor current associated with drive from the motor being taken up by the resilient component. As this drive is taken up the resilience of the resilient component gradually increases the resistance against the motor and this manifests itself as a monotonic increase in motor current superimposed upon any other fluctuations which may be present owing to the nature of the system. Detection of this increase allows the controller to ascertain that the suspension device has reached the end of its travel. No additional hardware such as limit switches is required.

The resilient component protects the motor from the effects of the suspension device abutting the stop and allows the motor to be stopped before the motor stalls and an associated overcurrent situation occurs. The increase in motor current can be detected in its early stages as an increase superimposed upon fluctuations arising from noise or from cyclic variations in motor current. This means that motor current can be interrupted at these early stages and well before the motor stalls, which is clearly advantageous.

The means for detecting the increase in current may include means for detecting a current in excess of a predetermined limit. This limit can be set sufficiently far above normal operating currents to minimize the chances of a false stop yet sufficiently far below the motor stall current to protect the motor against stalling. Preferably, however, the means for detecting the increase in current includes means for detecting the monotonic increase in current associated with the resilient component taking up drive from the motor, irrespective of the magnitude of the current. This latter form of detection is better in the cases where the weight of the blind/curtain is unknown at the time of manufacture, such as with blinds of varying lengths, or where the load on the motor will step increase, such as a blind/curtain traverse which is required to move an increasing number of suspension devices across the support. The monotonic increase in motor current associated with the resilient component taking up drive from the motor will manifest itself as a monotonic increase with a different characteristic than that attributable to the step increase and will again lend itself to easy detection.

In one embodiment of the first aspect of the invention, the resilient component is located between the stop and the suspension device and may take the form of a resilient compressible element, such as a compression spring. As the suspension device approaches the stop, the spring or compressible element beings to compress and this gives rise to the monotonic increase in motor current. Particularly where the support is a threaded shaft and the suspension device is mounted on a traversing nut, this arrangement contains an in-built protection against jamming problems because the spring or compressible element, just as it resists motion of the suspension device towards the stop, also assists motion of the suspension device away from the stop. Thus, the torque required to free the suspension device from the stop is always less than that which tightened it in the first place.

In an alternative embodiment of the first aspect of the invention, the resilient component is located between the motor and the suspension device and may take the form of a resilient drive link, such as a torsion coupling. The torsion coupling may take the form of a flexible bar or tube connecting the motor shaft with a driven shaft of the system. Once the suspension device abuts the stop, the torsion coupling begins to twist and this again gives rise to a detectable monotonic increase in motor current. Again, an in-built protection against jamming is present because the motor is always capable of providing a release torque in excess of the torque to which the suspension device is tightened against the stop, owing to the early detection of the monotonic motor current increase. It is relatively simple for the motor, when reversed, to exert the torque necessary to release the suspension device from the stop.

The present invention also extends to an electronic control for use in a system according to the first aspect of the invention. Thus, the invention also provides an electronic controller for use in a blind/curtain suspension system comprising a support carrying at least one suspension device arranged for movement relative to the support towards and away from a stop to open and close the blind/curtain, an electric motor coupled to the suspension device and operable to cause movement of the suspension device relative to the support and a resilient component adapted to take up additional drive from the motor once motion of the suspension device is retarded by the stop, the controller including means for detecting an increase in current to the motor associated with drive from the motor being taken up by the resilient component and means for interrupting current to the electric motor when the increase in motor current is detected.

Preferably, the controller comprises a microprocessor and the means for detecting an increase in motor current includes means for periodically sampling the current of the motor, the microprocessor being programmed to detect the increase in motor current from the successive current samples.

According to a second aspect of the invention, there is provided a blind/curtain suspension system comprising a support carrying at least one suspension device arranged for movement relative to the support between first and second stops to open and close the blind/curtain, an electric motor coupled to the suspension device and operable to cause movement of the suspension device relative to the support and a controller including means for deriving a value indicative of position of the suspension device relative to the first stop, means for detecting an increase in current to the motor associated with motion of the suspension device being retarded by the second stop, means for storing the derived value when the increase in motor current is detected and means for regulating drive to the electric motor during subsequent operation of the system in dependence upon the stored value to interrupt current to the motor when the derived value indicative of the actual position of the suspension device reaches a predetermined or settable value between zero and the stored value.

The system according to the second aspect of the present invention makes use of self-calibration. If the suspension device is required not to move fully from one end of its travel or angular range to the other, but only for example half way, the motor will be energized until the position of the suspension device indicated by the derived value is mid-way between the end points. Similarly, any other intermediate position can be selected by interpolation. Thus, just one calibration of the system can allow the system to "learn" enough about itself to provide a multiplicity of controlled positions and functions.

As will be described below, the system according to the second aspect of the present invention also does not require the use of limit switches and their associated hardware and does not suffer from the mechanical stress and jamming problems hitherto associated with the use of dead stops.

Once motion of the suspension device is retarded by the second stop on one occasion, the controller stores the derived value indicative of the position of the suspension device on the support and during subsequent operation of the system may not allow the suspension device to move to a position at which the derived value indicative of its actual position quite reaches the stored value or indeed goes to zero. In this way, although the suspension device may abut the second stop once, bringing to an end a first calibration run, it will not again do so until a further calibration is required. The system can be preset to allow any desired fraction of the full travel of the suspension device, e.g. 90%, 95%, 99% etc.

Preferably, the means for deriving a value indicative of position of the suspension device relative to the first stop includes first means for deriving an initial value indicative of position of the suspension device, second means for detecting an increase in current to the motor associated with motion of the suspension device being retarded by the first stop and third means for recalibrating the first means to yield a zero result when this increase in current is detected. Recalibration may be effected by simple subtraction or by zeroing a counter etc.

This enables the system to detect both of its end points by first driving the suspension device to one stop, to establish the point relative to which the position of the suspension device is to be measured, and then driving the suspension device to the other stop to establish the other limit of its travel. This detection of both end points is the preferred form of calibration run.

The present invention also extends to an electronic control for use in a system according to the second aspect of the invention. Thus, the invention also provides an electronic controller for use in a blind/curtain suspension system comprising a support carrying at least one suspension device arranged for movement relative to the support between first and second stops to open and close the blind/curtain, an electric motor coupled to the suspension device and operable to cause movement of the suspension device relative to the support, the controller including means for deriving a value indicative of position of the suspension device relative to the first stop, means for detecting an increase in current to the motor associated with motion of the suspension device being retarded by the second stop, means for storing the derived value when the increase in motor current is detected and means for regulating drive to the electric motor during subsequent operation of the system in dependence upon the stored value to interrupt current to the motor when the derived value indicative of the actual position of the suspension device reaches a predetermined or settable value between zero and the stored value.

As will be recognized, the value indicative of the position of the suspension device may be derived from time elapsed during which the motor is operative, measured for example by counting oscillator clock cycles, or by counting fluctuations in commutator current in the motor or, if a stepping motor is used, by counting stepping pulses to the motor. The latter two derivations will be preferred in the case where uneven load is expected, since they will give a more accurate indication of position.

Preferably, the controller is adapted to slow the speed of the suspension device as it approaches the stop. In a preferred embodiment, the controller is adapted to determine from the stored value the point at which to slow the drive when the suspension device is driven during normal use. For example, the suspension device may be driven at relatively fast speed throughout most of its travel and then be slowed to reduce its momentum or angular momentum and the speed at which it approaches the stop. This may be achieved by operating the motor at two fixed speeds, a relatively fast speed and a relatively slow speed or by means of a variable speed drive to the motor.

Again, the controller preferably comprises a microprocessor and the means for detecting an increase in motor current includes means for periodically sampling the current to the motor, the microprocessor being programmed to detect the increase in motor current from the successive current samples. Of course, both aspects of the invention can with advantage be embodied in a single system, in which case the increase in motor current may be the monotonic increase discussed above.

In the suspension system according to either aspect of the present invention, the support may be an elongate support, such as a blind headrail or a curtain rail or pole, and the suspension device may be arranged for longitudinal movement relative to the support. The suspension device may therefore be a blind traveller or a curtain ring or hook etc.

In the case where the system is for suspending curtains, but by no means only in those cases, and to avoid the disadvantage of having to manufacture a curtain suspension system in a large number of different sizes to fit every possible width of window, it is desirable to provide a system which reduces the number of required sizes by incorporating a simple means of adjustment. Thus, the stop can preferably be located on the support in any desired position to define the required width of opening. Because the position of the stop can be chosen at will according to the opening width required, the support itself need only be manufactured in a small number of discrete lengths. Preferably two stops are provided, one at each end of the travel of the suspension device.

Again, particularly where the system is for suspending curtains, but by no means only in those cases, the support may carry at least two suspension devices adapted to move in opposite directions. Stops may be provided for each suspension device although stops for just one will suffice.

Alternatively, the suspension device may be arranged for rotational movement relative to the support. Thus, the support may be a blind traveller and the suspension device a carrier for a blind vane mounted for rotation relative to the support. The blind may be a vertical louvre blind, but it will be understood that this is but one example only of the applicability of the present invention. Again, two stops are preferably provided, one at each angular limit of the rotation of the suspension device.

BRIEF DESCRIPTION OF THE DRAWING FIGURES

Specific embodiments of the invention will now be described by way of example only and with reference to the accompanying drawings in which.

DETAILED DESCRIPTION OF THE DRAWING FIGURES AND PREFERRED EMBODIMENTS

Figure 1:
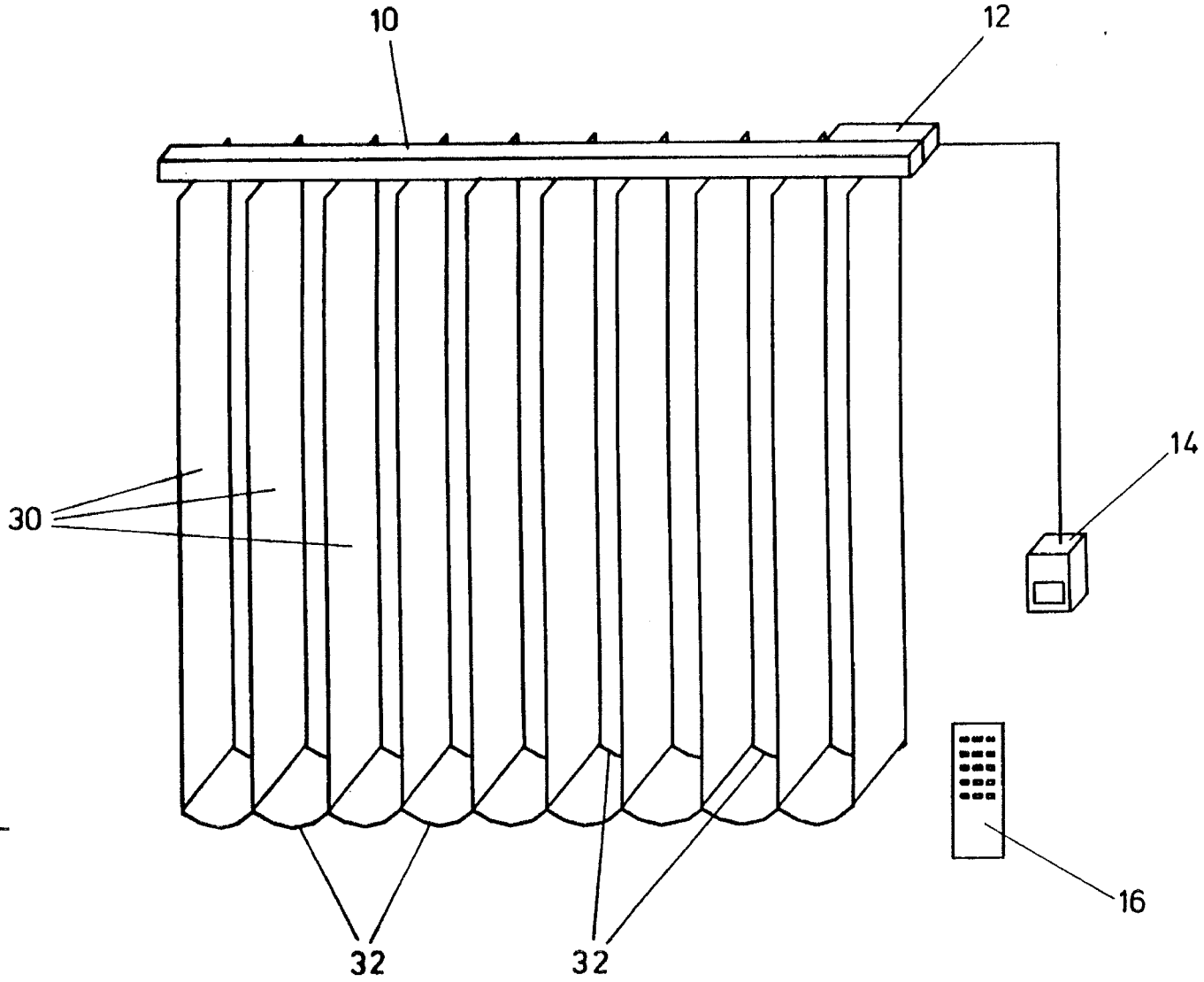
FIG. 1 shows in perspective a motorized blind installed at a window with the electronic controller and low voltage power supply.
Figure 2:
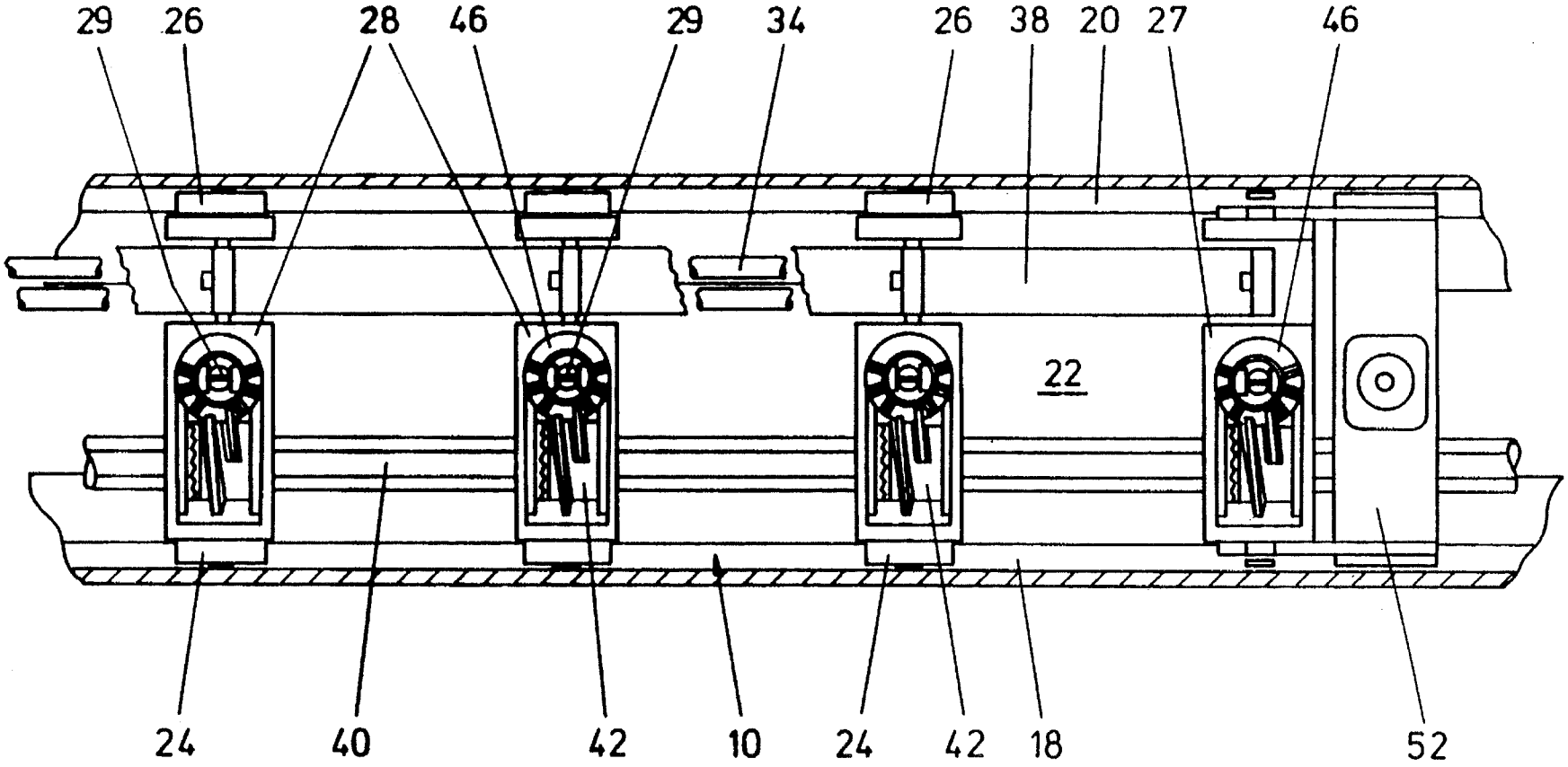
FIG. 2 is a plan view, partly in section, of a conventional vertical blind headrail, illustrating the working parts.

As illustrated in FIGS. 1 and 2, the automated vertical blind suspension system comprises an elongate support in the form of a motorized headrail 10 carrying a lead blind traveller 27 and a plurality of trailing blind travellers 28. The travellers each support a blind vane 30. The headrail 10 is connected to an electronic controller 12 which is electrically powered by a plug-top, low voltage dc power supply 14. A remote handset 16 is also illustrated and will be described below. The blind illustrated is a vertical blind, but it will be appreciated that the invention is equally applicable to any kind of blind or window covering system, for example venetian blinds.

The headrail 10 illustrated in FIG. 2 is in the form of an extruded aluminium section having a track 18, 20 on either side of a central space 22. A wheel 24, 26 on each side of the blind travellers 28 runs in a respective track 18, 20 to allow longitudinal movement of the travellers 28 relative to the headrail 10. A blind vane carrier 29 is clipped into and rotatably supported by each blind traveller 28 and projects downwards from the central space 22 of the headrail 10. The lower ends of adjacent blind vanes 30 are linked by articulated chains 32.

Figure 3:
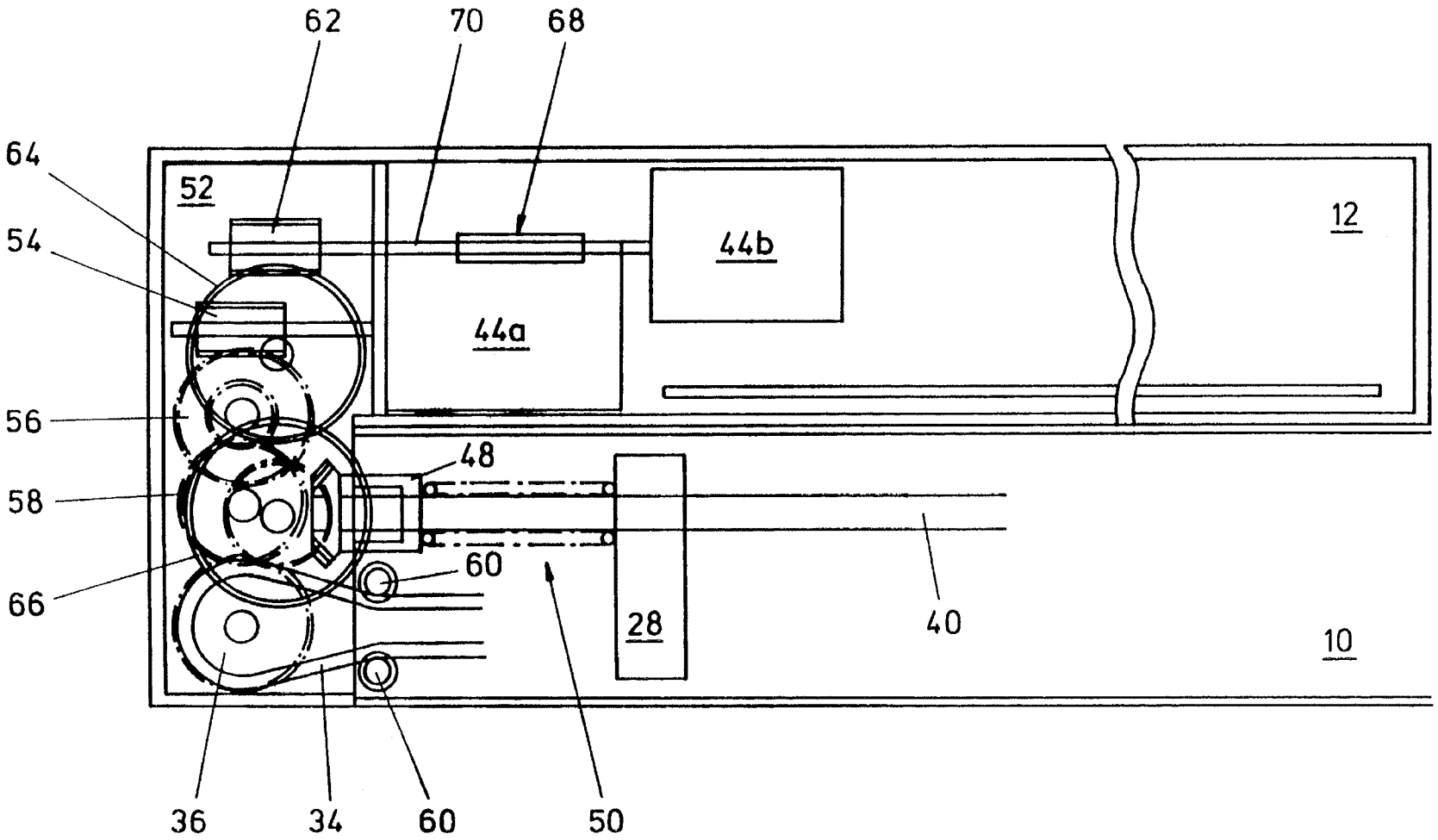
FIG. 3 is a schematic plan view of the end of a vertical blind headrail including the controller according to the present invention.

As is shown in more detail in FIG. 3, a cord 34 runs the length of the headrail 10 and is fixed to the lead traveller 27 in the conventional way. The cord 34 doubles back on itself forming a continuous loop, one end of which passes out of the end of the headrail 10 and around a drive wheel 36. The drive wheel 36 is controlled by the controller 12 via an electric motor **44*a* as will be discussed in greater depth below. Rotation of the drive wheel 36 causes the loop of cord 34 to circulate within the headrail 10 and hence causes the lead traveller 27 to advance along the headrail 10. The drive wheel 36 may be made of or coated with rubber, neoprene or the like to improve grip on the cord. As the lead traveller 27 advances, a spacer link 38 engages the next traveller 28 in line which in turn begins to advance and so on. When the travellers 28 are all bunched up at one end of the headrail 10 (blind open) the spacer links 38** stack up on one another in a telescopic fashion.

Also running the length of the headrail 10 is a profiled tilt shaft 40 which has a uniform profile throughout its length. Within each blind traveller 28 is a captive threaded sleeve 42 which moves longitudinally with the traveller 28 and surrounds the tilt shaft 40. The threaded sleeve 42 has a central drive bore at least partially corresponding in shape with the profile of the tilt shaft 40, so as to provide a positive drive, and each sleeve 42 will therefore rotate relative to its respective traveller 28 only when the tilt shaft 40 is rotated. The tilt shaft 40 passes through circular apertures in the travellers 28 and is thus free to rotate relative to the travellers 28. Owing to the uniformity of the profile of the tilt shaft 40 throughout its length, the threaded sleeves 42 may slide along the tilt shaft 40 as the travellers 28 traverse the headrail 10.

Each blind vane carrier 29 includes in its upper regions a pinion or crown gear 46 which engages the threaded sleeve 42 retained in its respective traveller 28. Thus, rotation of the tilt shaft 40 causes rotation in unison of all the threaded sleeves 42 which in turn causes rotation in unison of all the vane carriers 29 and hence the vanes 30 about a vertical axis.

The blind headrail 10 according to the invention differs from that illustrated in FIG. 2 in that the trailing traveller 28 is separated from an end stop 48 by a compression spring 50. Similarly, the other end of the headrail 10 includes a second end stop and a second spring attached to the stop. Each spring 50 surrounds the tilt shaft 40 which ensures that if one or other spring 50 is partially compressed, it does not tend to twist the leading or trailing traveller 28 relative to the tilt shaft 40, which could interfere with operation of the vane tilt mechanism.

The springs 50 are provided to stop the travellers 28 without occasioning mechanical stress. The springs 50 are designed such that the motor current will rise steadily as they go into compression, and the motion of the travellers 28 stops at a point of partial compression of the springs 50, e.g. approximately 30%, depending on the spring constant and motive power available. The electronic controller 12 is arranged to stop the motor drive when a monotonic increase in motor current associated with gradual spring compression is detected. A less preferred alternative is the detection of current exceeding a threshold corresponding to the motor current just prior to the required degree of partial compression of the springs 50, to allow for the residual inertia in the mechanism. These control methods are preferred due to their simplicity as compared with the conventional method of elaborate proximity or limit switches and their associated hardware.

In the preferred detection method, the controller 12 is adapted to take periodic samples of the motor current and is suitably programmed to discriminate between current increases due to the compression of the springs 50 and current increases or fluctuations arising from other sources. The maximum time between samples is determined by the spring constant and motive power available. The current sample is taken from an A/D converter, the analogue input of which receives a signal from the motor current sensor. Passive or active filtering, amplification or a combination of these techniques may be applied to the analogue inputs to filter out or reject unwanted frequencies, such as those arising from noise from the motor commutator, and to give the desired input amplitude which takes advantage of the A/D converter's input range.

As can be seen, drive is transmitted to the cord 34 from a traverse motor **44*a* through a gearbox 52 and specifically through gears 54, 56 and 58. Parallelism of the outgoing and return portions of the cord 34 is maintained by a pair of pinch wheels 60 located just within the headrail 10**.

A second motor, the tilt motor **44*b*, drives the tilt shaft 40 through the gearbox 52 and specifically through gears 62, 64 and 66. No springs 50 are provided to slow the rotation of the vane carriers 29 as they approach their limit stops (not shown) and indeed the limits of movement of the vane carriers 29 may be defined by stops within the vane carriers 29. Instead, the drive from the tilt motor 44*b* to the gearbox 52 is transmitted by means of a resilient torsion link, taking in this example the form of a neoprene or synthetic rubber tube 68 coupling the tilt motor 44*b* shaft to a driven input shaft 70 of the gearbox 52**.

The torsion link 68 is provided to stop the vane carriers 29 without occasioning mechanical stress. The link 68 is designed such that the motor current will rise steadily as it begins to twist, and the tilt motor **44*b* is stopped at a point at which the link 68 is partially twisted. The electronic controller 12 is arranged to stop the motor drive when a monotonic increase in motor current associated with gradual twist of the link 68 is detected. Again, a less preferred alternative is the detection of current exceeding a threshold corresponding to the motor current just prior to the required degree of twist of the link 68, to allow for the residual inertia in the motor 44*b***.

The control electronics are all implemented on a PCB contained within the controller 12 and include a programmed microprocessor which implements the detection, calibration, control and automatic operation algorithms.

As described above, the controller 12 includes means for deriving a value indicative of position of the lead traveller 27 relative to one limit of its motion. The value may be derived from timed clock pulses, motor commutator pulses or, if a stepping motor is used, stepping pulses, etc. The controller 12 is adapted to detect an increase in current to the motor **44*a* associated with motion of the traveller 28 being retarded by the stop 48 and this detection may be triggered by the current exceeding a predetermined threshold or, where a resilient component such as a compliant end stop is used, may utilize the same algorithm for detecting the monotonic motor current increase as is discussed above in connection with the first aspect of the invention. The controller 12 stores the derived value when the increase in motor current is detected and regulates drive to the electric motor 44*a* during subsequent operation of the system in dependence upon the stored value to interrupt current to the motor 44*a* when the derived value indicative of the actual position of the traveller 28 reaches a value which is either predetermined by the manufacturer, e.g. as a fixed percentage of the stored value, or is settable by the user, via a remote control handset. To determine the zero point of the measurement of position of the traveller 27, the controller firstly drives the traveller 27 towards the other end stop. Once an increase in current is detected attributable to the other end stop being reached, the controller 12** may zero the counter or keep a record of the derived value at that point, which is subsequently subtracted from other derived values to yield a relative position indication.

Similar considerations apply to the tilt mechanism as they do to the traverse mechanism, but the vane carriers 29 are rotated to either angular extreme by means of the tilt motor 44*b* so as to abut the stops formed in the travellers 28. Increase in motor current to the tilt motor 44*b* is detected by the microprocessor to determine the angular limits of the vane carriers' rotation.

If the system loses calibration, for example because of inaccuracies in determining the position of the travellers 28 or vane carriers 29, a re-calibration run can be executed so that the system can re-establish the limit value representing contact between the leading traveller 27 or vane carrier 29 and the appropriate stop. Similarly, if due to loss of calibration or as a result of normal operation the traveller 27 or vane carrier 28 ever contacts the appropriate stop, the controller 12 will immediately re-establish the limit value.

To accommodate different window widths the design allows for different lengths of headrail 10 to be made by altering the lengths of the extruded aluminium section, the drive cord 34 and the tilt shaft 40. It is intended that the headrail 10 be manufactured in several discrete lengths, but the overall length is not intended to be altered after sale. To allow for an adjustment of the opening width, the stops at one or both ends of the headrail 10 are designed to be relocated by the customer. In this way, many blind opening widths are possible for each given headrail length. For very long headrails 10 or in other situations where it may be advantageous to include motors at both ends of the headrail 10, a metallic headrail 10 or tilt shaft 40 may be employed to conduct electricity from end to end. Brushes or other pick-up means may be provided on the tilt shaft 40.

As has been mentioned above, to achieve automatic control of the motorized headrail 10 an electronic controller 12 is provided. This controller 12 provides a drive of the correct polarity to both the traverse and tilt motors 44*a*, 44*b* by means of four small cables, power being derived from the plug-top, low voltage dc power supply 14.

Figure 4:
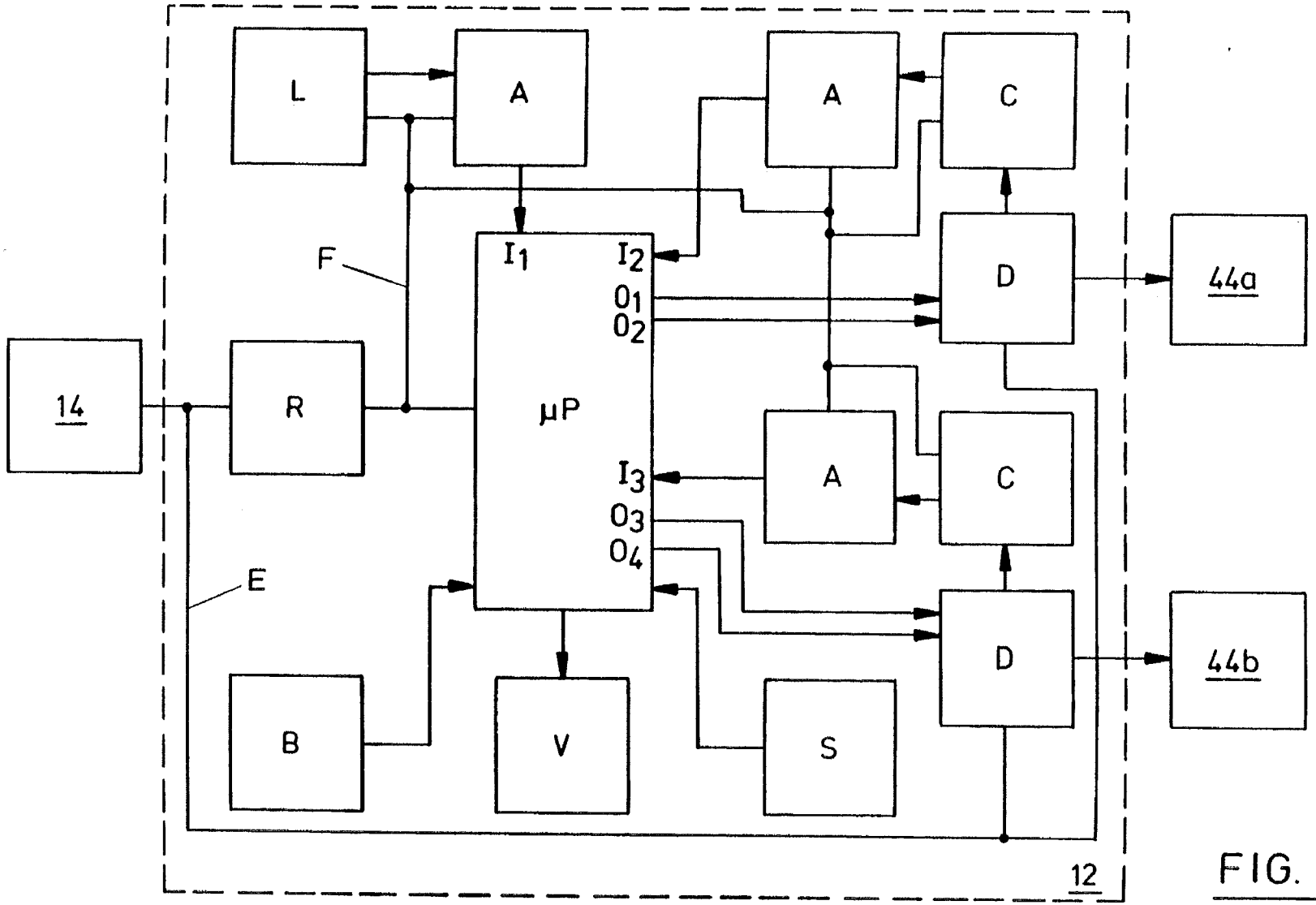
FIG. 4 is a block diagram of the electronic controller suitable for use with the arrangement shown in FIG. 3.

The electronic controller 12 is entirely solid state to improve its reliability. FIG. 4 shows the block diagram which consists of a first sensor comprising: a light sensor (L) which monitors the incident light transmitted through the window from outside; a pair of motor drive current sense circuits (C) which produce a pair of second signals; three analog to digital converters (A), which convert the light sensor output to a digital value and the motor drive currents to digital values for input to the microprocessor (μP) via three separate inputs ($I_1$, $I_2$, $I_3$); two pairs of outputs ($O_1$, $O_2$; $O_3$, $O_4$) from the microprocessor to a pair of transistor bridge motor drive circuits (D) to control motor drive and its polarity and as a result the direction of movement of the blind travellers 28 and vane angular position; a regulator circuit (R) to which unregulated +12 V dc (E) is supplied to be regulated down to a clean +5 V supply (F) required for the control electronics; an infra-red receiver (B) to provide mode control and manual operation by receipt of instructions from a manually operated remote unit 16; three light emitting diodes (V) to give visual indication of status; and a switch (S) to allow hardware selection of the controller's address (discussed below).

The light detector (L) or infrared receiver (B) may be provided with a molded lens or filter to reject unwanted wavelengths. The lens is preferably a collecting lens larger in size than the width of a traveller 28 so that if a traveller 28 comes to rest in front of the receiver, the infra-red encoded instructions can nevertheless be received.

Preferably, the controller 12 will include an electronic communication link by means of which a multiplicity of electronic controllers 12 may be connected in a daisy chain so that several installed systems may be operated simultaneously. One of the electronic controllers 12 is selected as a master control device and the other electronic controllers 12 downstream in the daisy chain as slave devices which follow the operation through relayed instructions from the master. Each slave device in turn relays the instructions received from the controller 12 immediately upstream in the daisy chain to the controller 12 immediately downstream and ignores instructions received from the remote unit 16. A communications interface board in each controller 12 facilitates this arrangement.

The blind controller 12 includes provision for a "LIGHT SENSE" mode, in which the blind is opened or closed depending upon incident light readings taken from the light sensor (L). To provide robust operation of the electronic controller 12, the microprocessor code implements hysteresis according to certain algorithms on the digital values used to determine the light sensor level at which to indicate dark or light status. In this example, a higher digital value from the analogue to digital converter (A) is used to indicate that light status is reached, than the digital value use to indicate that dark status is reached. Hysteresis utilized in this manner will stop the dark/light status changing due to small variations in the light incident upon the light sensor (L) and gives an immunity to any noise that may be added to the light level signal. The pairs of hysteresis values can be selected using the remote unit 16 to allow adjustment of light sensitivity and to give immunity to small variations in incident light level and moderate levels of additive electrical noise.

A plurality of light sensors (L) may be utilized to enable the controller 12 to track the position of the sun and angle the blind vanes 30 accordingly to allow more or less incident sunlight to pass or be prevented from passing through window.

If motor current increase is detected by comparing the sensed current value with a predetermined threshold, to improve the immunity to noise and false motor drive status indication due to small changes in value of the motor drive current digital hysteresis is programmed into the microprocessor code in a similar manner to that for the light sensor (L) above to provide immunity to small changes in motor drive current and moderate levels of additive electrical noise. In this case the higher value programmed represents the current at which the stop springs 50 in the headrail 10 reach the aforesaid degree of partial compression or the torsion link 68 reaches the aforesaid degree of twist, and the point at which the microprocessor (μP) outputs to the motor drive circuit (D) to stop the motor drive. The microprocessor (μP) is programmed to ignore the instantaneous high level motor current at the start of the motor drive cycle. This is done by masking the input for a short period of time, 250 mS in this example, by which time the motor current will have fallen to its nominal operational value and the motor current sensing input is re-enabled.

To provide intelligent control of the motorized headrail 10 in a manner that gives reliable and predictable operation, the design incorporates a microprocessor (μP) which is programmed to implement algorithms which cannot be implemented in readily available discrete logic elements without extremely complex and sizeable circuitry.

To avoid false stimuli of the motor drive circuits (D) and hence blind operation due to events such as car headlamps or other transitory light sources becoming incident upon the light sensor (L) or transitory periods of darkness caused for example by the obscuring of the light sensor (L), a timer $t_1$ within the microprocessor, is initiated as one of the light sense hysteresis threshold is crossed from light to dark or dark to light. The time $t_1$ is set for a period of time T, in this example 5 minutes. The motor drive circuit (D) is only enabled if the appropriate light or dark level is maintained for the whole period T, indicating the transition is not transient but true, the digital values from the analogue to digital converter (A) being sampled at regular sub-second intervals by the microprocessor (μP).

To allow blind operation during dark periods due to storms and overcome the problem of blinds being withdrawn at first light in summer, a further timer $t_2$ is reset and started at the transition from light to dark. Provided this digital value for dark is maintained about the hysteresis threshold for time T, the blind is driven closed. For an intermediate period of time $T_2$, in this case 3 hours of timer $t_2$, the controller 12 will open the blind providing the light sensor level is stable, indicating light status, for period T on first timer $t_1$. This allows for operation during a storm and, as in the UK the minimum dark period at the summer solstice is greater than 3 hours, does not give rise to blind opening during period $T_2$. After a period $T_2$ has elapsed on timer $t_2$ a second or remaining time period $T_3$, in this case 6 hours is timed during which the operation of the motor drive is inhibited by the microprocessor (μP). This is to stop the blind being opened at first light in summer. After the period $T_3$ has elapsed the opening of the blind is dependent upon the light sensor level digital value giving continuous light status indication for a period T. If this is the case, the motor drive circuits (D) are energised to open the blind. This method of control gives the advantage of the desired operation during the summer and winter.

The versatility of the controller 12 may be enhanced by the addition of a time clock. This enables the controller 12 to store the operating times each day that result in time period $T_3$ elapsing and utilize the average of several days operation to determine whether a control stimulus is to be acted upon. This gives the electronic controller 12 the ability to avoid erroneous operation due to periods of dark in bad weather.

In addition to the ability of the controller 12 to store the operating times for each day, and utilize the average of several days to avoid erroneous operation, the controller 12 may be provided with a "TIME LEARN" facility to allow for storage of manually initialized operations over a period of one or more days, in such a manner that the operational sequence stored over the period may be selected to repeat automatically in a "TIME OPERATE" mode until otherwise instructed. A "store" may be added to allow selective storing of operations only. A time mask is preferably used in "TIME LEARN" mode to reduce the number of store allocations required and to eliminate the storage of short term commands. For example, a command which is reversed within a short period of time will not be stored, and repetitions of the same command will similarly not be stored. As an example, once a command has been stored, no further commands may be stored for a fixed period of time, for example 4 or 6 hours.

A means of daily time control is provided in an alternative embodiment by the provision of a time clock as above to scroll round a look up table containing the desired opening and closing times for each day or week of the year programmed to the requirements of the specific application. In either case the week number followed by the day is programmed on installation. A battery backup is provided in this case to keep the clock and the date active in the case of mains power failure. Non-volatile memory is provided in the controller 12 to allow it to store data on current settings in addition to times etc. learned by the controller 12 so that these data are not lost if there is a power failure. Both the battery backup and the use of non-volatile memory are of benefit in all applications where memory is used to retain time or threshold values.

The open and close controls mentioned above are applicable to the traverse of curtains or blinds and/or the rotation of blind vanes.

To facilitate testing during operation without the need to wait a significant period of time between tests, a test link or contact is provided that alters the timing algorithms implemented by the microprocessor on all timers to enable testing in a short period of time.

The remote control unit 16 and the various modes which the controller 12 can implement will now be described in further detail. The remote handset 16 will include a number of keys of a self-explanatory nature. These will include "Tilt rotate anti-clockwise", "Tilt rotate clockwise" etc. In addition, a number of "one-shot" keys are provided such as "Traverse open" or "Traverse close". On receipt of the "Traverse open" instruction from the remote handset 16, the controller 12 will first cause the vanes 30 to tilt to 90 degrees to the headrail 10 and will then cause the travellers 28 to move to one side. Similarly with the "Traverse close" instruction, where the controller 12 will firstly cause the travellers 28 to be distributed along the headrail 10 and then cause the vanes 30 to rotate to one or other limit of their movement and thus be closed. Other one-shot keys, which are self explanatory in function, are "Open tilt to 45 degrees", "Open tilt to 90 degrees", etc.

Various toggle buttons will be provided on the handset 16 enabling the controller 12 to toggle into and out of its variety of operational modes. Thus there will be a "LIGHT SENSE" toggle button to enter and leave the "LIGHT SENSE" mode described above. Other modes available are "TIME LEARN /OPERATE" and "SOLAR PROTECT". Initial depression of the "TIME LEARN/OPERATE" toggle button, if there is no time pattern stored in memory will cause a limited number and type of manual operations to be stored in memory per 24 hour period for seven days. After a week has elapsed, the system will repeat these operations until this mode is exited. Once a time pattern has been stored, operation of the "TIME LEARN /OPERATION" toggle button will cause the system immediately to enter the automatic operation.

In "SOLAR PROTECT" the vane tilt is automatically controlled in response to light levels detected to shield the room and room furnishings from bright sunlight. Thus, if a high level of light is detected, the blind will be traversed closed and the vanes 30 tilted to a closed position. Once the light level subsides, the vanes 30 are returned to their original position. In each of these modes, the keys on the remote handset 16 which are not applicable to that particular mode will be disabled, i.e. the controller 12 will ignore them. For example, in the case that "SOLAR PROTECT" is operational due to the detection of a high level of sunlight, the only key not disabled is the key to disable "SOLAR PROTECT".

As mentioned above, the detection thresholds can be adjusted using keys on the handset 16, and so too can the various time delays implemented in software and "+/–" keys are provided for this purpose. In addition, recalibration of the limit value discussed above may be initiated by another key on the handset 16.

As mentioned above, each controller 12 includes a switch which can define its address, the address being a number in this example from 0 to 3. This is particularly useful where more than one controller 12 is to be instructed independently by the handset 16. Instructions from the remote handset 16 are preceded by a header code containing information as to which controllers 12 are to implement the instructions and keys on the handset 16 may be utilized to change the address in the header. Four keys are available in this example—"Address 1 select", "Address 2 select" and "Address 3 select", which change the information in the header to indicate that only those controllers 12 which have their address switch set to the corresponding number should respond, and "All addresses select", which changes the header to indicate that all controllers 12 should respond. Once one of these keys has been depressed, the address remains in effect until another of the address keys is depressed. To implement this arrangement, the handset 16 preferably includes a microprocessor. In addition, the handset 16 may give visual feedback, such as an indication of which addresses are selected or information received back from the controller 12 via infra-red transmission.

Status indication for each controller 12 is provided by light emitting diodes (V). In this example, three separate LEDs are used, coloured red, green and amber. Red constantly on indicates manual operation. Green constantly on indicates "LIGHT SENSE" mode. Red flashing on for one second in every two indicates "TIME LEARN" and "TIME OPERATE" is indicated by the green LED flashing in this way instead of the read. "SOLAR PROTECT" is indicated by the amber LED flashing for one second in every six and this may coincide with other flashing modes.

Adjustments using "+/–" keys are assisted by a gradual transition from red fully illuminated to green fully illuminated, passing through a plurality of intermediate stages in which the LEDs are illuminated to corresponding intermediate intensity levels. These intermediate illuminations are effected by modulating the LED power supplies at sub-second intervals. For normal use, the separation of the green and red LEDs is at present preferably 12 mm.

Because the intermediate settings are indicated by the relative intensities of at least two LEDs, with the limit settings having only one LED illuminated and the nominal middle setting having the LEDs exhibiting equal illumination intensities, the effectiveness of this method of visual indication is not dependent on the user having perfect color vision as would, for example, a method relying on the color change of one tri-color LED. This form of visual feedback makes it particularly easy for a user to select further intermediate settings by balancing the relative intensities of the LEDs.

Figure 5:
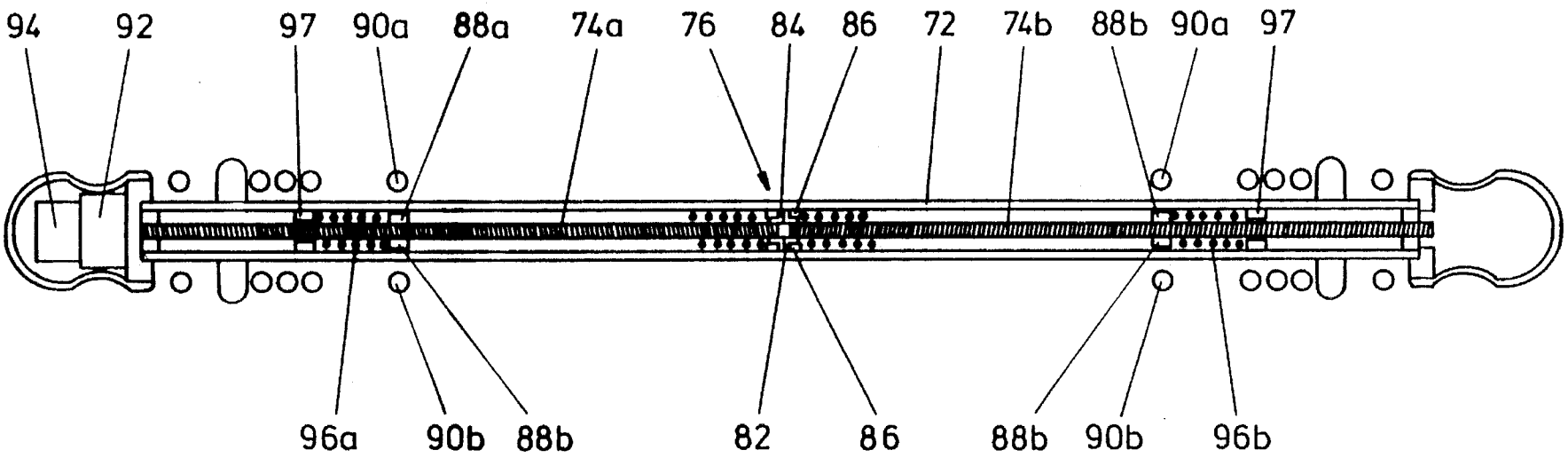
FIG. 5 illustrates a section through a motorized curtain pole system according to the invention.

FIG. 5 illustrates the application of the present invention to curtain poles. Of course, a curtain suspension system could be provided using a modified blind headrail 10, with the tilt facility removed and with curtain hooks suspended from the travellers 28. Such a headrail may be mounted in any orientation depending on the nature of the curtain hook carriers and drive to the travellers 28 will be carried by a cord 34. Nevertheless there are situations where the appearance of a curtain pole is to be preferred.

The curtain pole takes the form of a slotted tube 72, which may be made by extrusion, within which there are mounted right-hand and left-hand sections of threaded shaft 74*a*, 74*b* joined by a coupling 76 in a central region of the tube 72. The left-hand and right-hand sections of the threaded shaft 74*b*,74*a* are conveniently mounted for rotation within the slotted tube 72 by means of bushes 86. A first stop is provided in the form of a pair of bushes 86 located around the coupling 76 and a pair of second stops is provided in the form of two customer-locatable end stops 97.

In order for the motorized curtain pole as illustrated in FIG. 5 to function when the motor is driven, a gearbox is coupled to the end of the left hand threaded shaft 74*b* upon which rides a traversing nut 88*b* which travels in a direction determined by the motor drive polarity. The right hand threaded shaft 74*a* rotates with the left hand threaded shaft 74*b* by means of the two-part coupling 76. The coupling parts 82, 84 illustrated in FIG. 5 are formed by having protrusions and recesses in the form of pegs and holes in which allow them to mate, they also act as bearings in conjunction with bushes 86 that hold the coupling together and hold it in the center of the tube 72. A second traversing nut 88*a* rides upon the right hand threaded shaft 74*a*. As the traversing nuts 88*a*, 88*b* are prevented from rotating with the threaded shafts 74*a*, 74*b* by a small peg (not shown) which locates within the slot (not shown) in the tube 72, drive to the motor of a given polarity will cause the nuts 88*a* 88*b* to be driven in opposite directions. The traversing nuts 88*a*, 88*b* carry respective leading curtain rings 90*a*, 90*b*.

Although it is envisaged that the systems would in most cases be operated by means of the motor, it is preferred that the coupling between the traversing nuts 88*a*, 88*b* and the leading curtain rings 90*a*, 90*b* can be removed, such that the curtains may be drawn and opened entirely manually. Thus, there is conveniently provided a removable coupling which couples each nut 88*a*, 88*b* to a respective curtain ring 90*a*, 90*b*. Preferably, the coupling which holds the lead ring 90*a*, 90*b* in position on the traversing nuts 88*a*, 88*b* allows easy disengagement of each lead ring 90*a*, 90*b* from its traversing nut 88*a*, 88*b* should the motorized curtain pole be required to be used as a standard curtain pole, such as in the event of a mains supply failure. The coupling between the traversing nuts 88*a*, 88*b* and the lead rings 90*a*, 90*b* may be a magnetic coupling. In this way it is easy and convenient to disengage the lead rings 90*a*, 90*b* from the traversing nuts 88*a*, 88*b* for manual operation of the curtains. No mechanism has to be disengaged and the magnetic coupling can easily and conveniently be re-engaged following manual operation.

The threaded shaft 74*b* is coupled at one end to a gearbox 92 and a reversible electric motor 94, the shaft 74*b* being caused to rotate in one direction when the motor 94 is driven with a certain polarity and in the opposite direction when the motor 94 is driven with the reverse polarity. To alleviate the torsional stress that would be occasioned if the traversing nuts 88*a*, 88*b* were to stop by direct contact with the fixed first and second stops, compression springs 96*a*, 96*b* are provided on the shafts 74*a*, 74*b* against the stops, such that the springs 96*a*, 96*b* are gradually compressed as the traversing nuts 88*a*, 88*b* approach the stops. This results in a gradual increase in motor current as more torque is required for further compression. The electronic controller 12 is arranged to stop the motor drive when a monotonic increase in motor current associated with gradual spring compression is detected. A less preferred alternative is the detection of current exceeding a threshold corresponding to the motor current just prior to the required degree of partial compression of the springs 96*a*, 96*b*, to allow for the residual inertia in the mechanism. The springs 96*a*, 96*b*, when partially compressed, exert a force on the traversing nuts 88*a*, 88*b* which aid the start of shaft rotation when the motor 94 is driven with the reverse polarity.

The slot in the extended tube 72 and the design of the traversing nuts 88*a*, 88*b* are such that the slot and ring carrying pegs are at the rear of the tube 72 on installation facing the wall on which the system is mounted. This enables the appearance of the motorized curtain pole to be that of a standard curtain pole from most normal viewing angles.

I claim:

1. A blind/curtain suspension system, comprising:

a support;

at least one suspension device carried by said support and being arranged for movement relative to said support for opening and closing the blind/curtain;

an electric motor coupled to said suspension device and operable for causing movement of the suspension device relative to said support;

a stop and a resilient component onto which the suspension device impinges at one end of its range of motion, said resilient component being located between said suspension device and said stop so that said resilient component is resiliently stressed as said suspension device approaches said one end of its range of motion; and, a controller including means for detecting an increase in current to said electric motor associated with said electric motor resiliently stressing said resilient component and means for interrupting current to said electric motor when the increase in electric motor current is detected.

2. The blind/curtain suspension system according to claim 1, wherein said means for detecting the increase in current includes means for detecting a monotonic increase in current associated with said electric motor resiliently stressing said resilient component.

3. The blind/curtain suspension system according to claim 1, wherein said resilient component comprises a resilient compressible element which is compressed as said suspension device approaches said one end of its range of motion.

4. The blind/curtain suspension system according to claim 1, wherein said support is an elongate support and said suspension device is arranged for longitudinal movement relative to said support.

5. The blind/curtain suspension system according to claim 1, wherein said suspension device is arranged for rotational movement relative to said support.

6. A blind/curtain suspension, comprising:

a support;

at least one suspension device carried by said support and being arranged for movement relative to said support for opening and closing the blind/curtain;

a first stop and a second stop onto which said suspension device impinges at respective ends of its range of motion;

an electric motor coupled to said suspension device and operable for causing movement of the suspension device relative to said support; and, a controller including means for deriving a value indicative of position of said suspension device relative to said first stop, means for detecting an increase in current to said electric motor associated with said suspension device impinging on said second stop, means for storing said value when the increase in electric motor current is detected and means for regulating said electric motor during subsequent operation of said system in dependence upon said value so stored for interrupting current to said electric motor when said value indicative of an actual position of said suspension device reaches a predetermined, or settable, value between zero and said value so stored.

7. The blind/curtain suspension system according to claim 6, wherein said means for deriving a value indicative of position of said suspension device relative to said first stop includes first means for deriving an initial value indicative of position of said suspension device, second means for detecting an increase in current to said electric motor associated with said suspension device impinging on said first stop and third means for recalibrating said first means for yielding a zero result when the increase in current is detected.

8. An electronic controller for use in a blind/curtain suspension system comprising a support: at least one suspension device carried by said support and being arranged for movement relative to said support for opening and closing a blind/curtain; an electric motor coupled to said suspension device and operable for causing movement of said suspension device relative to said support; and, a stop and a resilient component onto which said suspension device impinges at one end of its range of motion, said resilient component being located between said suspension device and said stop so that said resilient component is resiliently stressed as said suspension device approaches said one end of its range of motion;

said electronic controller comprising means for detecting an increase in current to said electric motor associated with drive from said electric motor being taken up by said resilient component and means for interrupting current to said electric motor when the increase in the current in said electric motor is detected.

9. The electronic controller according to claim 8, further comprising a microprocessor, and in which said means for detecting an increase in the current of said electric motor includes means for periodically sampling the current to said electric motor, said microprocessor being programmed for detecting the increase in the current of said electric motor from successive current samples.

10. An electronic controller for use in a blind/curtain suspension system comprising a support, at least one suspension device carried by said support and being arranged for movement relative to said support for opening and closing a blind/curtain; a first stop and a second stop onto which said suspension device impinges at respective ends of its range of motion; and, an electric motor coupled to said suspension device and operable for causing movement of said suspension device relative to said support;

said electronic controller comprising means for deriving a value indicative of position of said suspension device relative to said first stop, means for detecting an increase in current to said electric motor associated with motion of said suspension device being retarded by said second stop, means for storing said value derived when the increase in the current of said electric motor is detected, and means for regulating drive to said electric motor during subsequent operation of said system in dependence upon said value so stored for interrupting current to said electric motor when said value indicative of actual position of said suspension device reaches a predetermined, or settable, value being zero and said value so stored.

11. The electronic controller according to claim 10, wherein said means for deriving a value indicative of position of said suspension device includes means for determining time elapsed during which said electric motor is operative.

12. The electronic controller according to claim 10, wherein said means for deriving a value indicative of position of said suspension device includes means for counting cyclic fluctuations in commutator current in said electric motor.

13. The electronic controller according to claim 10, wherein said electric motor is a stepping motor and said means for deriving a value indicative of position of said suspension device includes means for counting stepping pulses to said electric motor.

14. The electronic controller according to claim 10, further comprising means for slowing the speed of said suspension device as said suspension device approaches a stop.

15. A blind/curtain suspension system, comprising:

a support;

at least one suspension device carried by said support and being arranged for movement relative to said support for opening and closing a blind/curtain;

a stop onto which said suspension device impinges at one end of its range of motion;

an electric motor;

a drive train coupling said electric motor to said suspension device so that said electric motor is operable for causing movement of said suspension device relative to said support, said drive train including a resilient component being resiliently stressed by said electric motor when said suspension device impinges on said stop; and, a controller including means for detecting an increase in current to said electric motor associated with said electric motor resiliently stressing said resilient component and means for interrupting current to said electric motor when the increase in the current of said electric motor is detected.

16. The blind/curtain suspension system according to claim 15, wherein said means for detecting the increase in current includes means for detecting a monotonic increase in current associated with said electric motor resiliently stressing said resilient component.

17. An electronic controller for use in a blind/curtain suspension system comprising a support, at least one suspension device carried by said support and being arranged for movement relative to said support for opening and closing a blind/curtain, a stop onto which said suspension device impinges at one end of its range of motion, an electric motor and a drive train coupling said electric motor to said suspension device so that said electric motor is operable for causing movement of said suspension device relative to said support, said drive train including a resilient component being resiliently stressed by said electric motor when said suspension device impinges on said stop;

said electronic controller comprising means for detecting an increase in current to said electric motor associated with drive from said electric motor being taken up by said resilient component and means for interrupting current to said electric motor when the increase in the current of said electric motor is detected.

18. The electronic controller according to claim 17, further comprising a microprocessor, and wherein said means for detecting an increase in the current of said electric motor includes means for periodically sampling the current to said electric motor, said microprocessor being programmed for detecting an increase in the current of said electric motor from successive current samples.

* * * * *